US005662492A

United States Patent [19]

Weiss

[11] Patent Number: 5,662,492

[45] Date of Patent: Sep. 2, 1997

[54] ELECTRICAL CONNECTOR ELEMENT

[75] Inventor: Christopher John Weiss, Cheltenham, Australia

[73] Assignee: Alcatel Components Limited, Moorabbin, Australia

[21] Appl. No.: 480,345

[22] Filed: Jun. 7, 1995

[30] Foreign Application Priority Data

Jul. 4, 1994 [AU] Australia ..... PM6587

[51] Int. Cl.[6] ..... H01R 4/24

[52] U.S. Cl. ..... 439/404; 439/607

[58] Field of Search ..... 439/404, 417, 439/437, 438, 440, 452, 461, 462, 467, 607, 610

[56] References Cited

U.S. PATENT DOCUMENTS

| | | | |
|---|---|---|---|
| 2,115,642 | 4/1938 | Martin | 439/751 X |
| 2,718,625 | 9/1955 | Harrison | 439/682 |
| 2,764,748 | 9/1956 | Heller | 439/393 |
| 3,993,388 | 11/1976 | Konzorr | 439/459 |
| 4,913,661 | 4/1990 | Gellenthin, Jr. et al. | 439/438 |
| 5,102,351 | 4/1992 | Meshel | 439/607 |
| 5,145,409 | 9/1992 | Sato et al. | 439/610 X |
| 5,151,053 | 9/1992 | Shinji et al. | 439/610 |
| 5,439,388 | 8/1995 | Weiss et al. | 439/462 X |
| 5,478,254 | 12/1995 | Holt | 439/610 X |

FOREIGN PATENT DOCUMENTS 4149093 1/1994 Australia .

*Primary Examiner*—Allan N. Shoap
*Assistant Examiner*—Christopher J. McDonald
*Attorney, Agent, or Firm*—Ware, Fressola, Van Der Sluys & Adolphson

[57] ABSTRACT

A connector element for a two-part coupling connector having a wire holding part (9) and a contact holding part (5) axially supporting within its boundary at least one insulation displacement element (6). The contact holding part includes a contact spring (8) arranged to resiliently urge a shielding braid pig-tail of a cable whose insulated conductors (14, 15, 16 and 17) are held by the wire holding part, into a recess (20) in the contact holder part for providing a resilient electrical contact with the shield.

8 Claims, 4 Drawing Sheets

ELECTRICAL CONNECTOR ELEMENT

TECHNICAL FIELD

This invention relates to electrical connectors, particularly two-part coupling connectors for disconnectably interconnecting the conductors of cords, such as audio cables, or disconnectably connecting the conductors of audio cables to appliances, the contact of each coupling part being arranged on line parallel with the direction of coupling-engaging motion.

BACKGROUND OF THE INVENTION

Such a coupling connector is known from the specification of Australian patent application No. 41490/93, which discloses a connector element having contact elements to which the conductors of a cord are connected via insulation displacement parts of the contact elements. The insulated conductors and a spiral shielding wire are laid in respective channels of a wire holding part such that the insulation displacement parts of the contact element, in the form of a slotted plate, penetrate the insulation of the insulated conductors and establish electrical connection between the conductors and the contact elements when the connector element and the wire holding element are mated. The shielding wire is formed into a pig-tail and also contacted by a respective insulation displacement contact element.

In some applications, particularly microphone cable applications, the cable to be connected to a coupling connector element of the aforementioned kind comprises a relatively heavy braided shield which is approximately eight times the mass of an insulated conductor of the cable. A problem arises in that the insulation displacement blade which contacts the braided shield pig-tail laid in a channel will be damaged because its design is appropriate for a smaller mass insulated conductor.

SUMMARY OF THE INVENTION

It is an object of the present invention to provide a coupling connector element comprising a contact element for reliably contacting a braided shield pig-tail.

According to the invention there is provided an electrical connector arrangement for making electrical connection between at least one contact element and a corresponding conductor, the arrangement including a contact element carrying pad from which at least one contact element protrudes having a resilient formed end, and a mateable conductor holding part including at least one slot to receive said at least one contact element having the formed end and an end of said conductor, wherein said formed end is shaped to be a compression fit in said slot whereby contact pressure is established between the contact element and the conductor within said slot upon mating said contact element carrying part and said conductor holding part.

According to a further aspect of the invention, there is provided an electrical connector arrangement for a sheathed cable containing at least one insulated conductor and a conductive shield element, said connector arrangement comprising:

an assembly of an outer shell member in which is fixedly located an insert member having fixedly supported within its boundary at least one first forwardly-extending contact element whose opposite end terminates in a rearwardly-extending insulation-penetrating means, and one second forwardly extending contact element whose opposite end terminates in a rearwardly-extending contact spring having a resilient formed end;

a mateable insulated-wire terminal means including at least one first slot arranged to receive said insulation penetrating means, and a second slot arranged to receive said formed end of said rearwardly-extending contact spring and an end of said conductive shield element, when said contact element housing and said insulated wire terminal means are axially mated, an insulated wire guide means being arranged transverse said first slot, and said formed end being shaped to be a compression fit in said second slot;

a cup-shaped end member having a side wall joined by an end wall in which is provided a co-axial hole for receiving said sheathed cable therethrough and coupling means for releasably coupling said end member and said shell member;

said insulated wire terminal means including a cable gripping means having two longitudinal limbs extending rearwardly from said insulated-wire terminal means to form a pair of jaws, at least one limb being hinged by hinge means; and one of the two said limbs being provided intermediate its length with an inwardly extending protuberance opposite a space defined by two raised shoulders that extend inwardly from the other said limb, whereby when an end section of said cable is laid longitudinally between said limbs and a length of exposed at least one insulated conductor laid in said guide means, a part of said end section bridges said space such that upon dosing said jaws, mating said contact element housing and said insulated-wire terminal means, and coupling said end member and said shell member, said part of said end section of said cable is pinched and gripped between said shoulders and said protuberances, and said insulation-penetrating means cuts the insulation of said at least one insulated wire in said guide means to provide electrical connection between said insulated wire and said first forwardly extending contact element, and contact pressure is established between said formed end of said contact spring and said end of said conductive shield element to provide electrical connection between said conductive shield element and said second forwardly-extending contact element.

In electrical connector applications, particularly microphone cable connector applications, it is preferred, for reliability, to use quadded cable. The four conductors of the quadded cable are formed into two conductors each consisting of two electrically parallel conductors for connection to a two pole circuit. If a connector element having insulation displacement contacts is used the pairs of insulated conductors forming each "conductor" are stacked in a channel of the wire holding element, that is, a common plane bisecting both conductors also longitudinally bisects the slot. Both conductors are contacted by the insulation displacement element's cutting edge within the slotted plate. A problem can arise in that when both insulation conductors enter the slot, the slot may deform and contact with one or both conductors in the slot may be unreliable.

It is a further object of the invention to provide an insulation displacement slotted plate which can reliably accommodate and contact two stacked insulated conductors.

According to a still further aspect of the present invention, there is provided an insulation displacement contact having a slot formed between a pair of contact arm with width W adapted to receive wires with an insulation diameter DO and a wire diameter DI, wherein DI is greater than W, wherein the deformation characteristics of the wires when inserted into the slot and the resilience of the contact arms are such that the edges of the contact arms forming the slot make electric contact with each of a pair or wires inserted into the slot.

BRIEF DESCRIPTION OF THE DRAWINGS

In order that the invention may be readily carried into effect, embodiments thereof will now be described in relation to the accompanying drawings, in which.

BEST MODE FOR CARRYING OUT THE INVENTION

Figure 1:
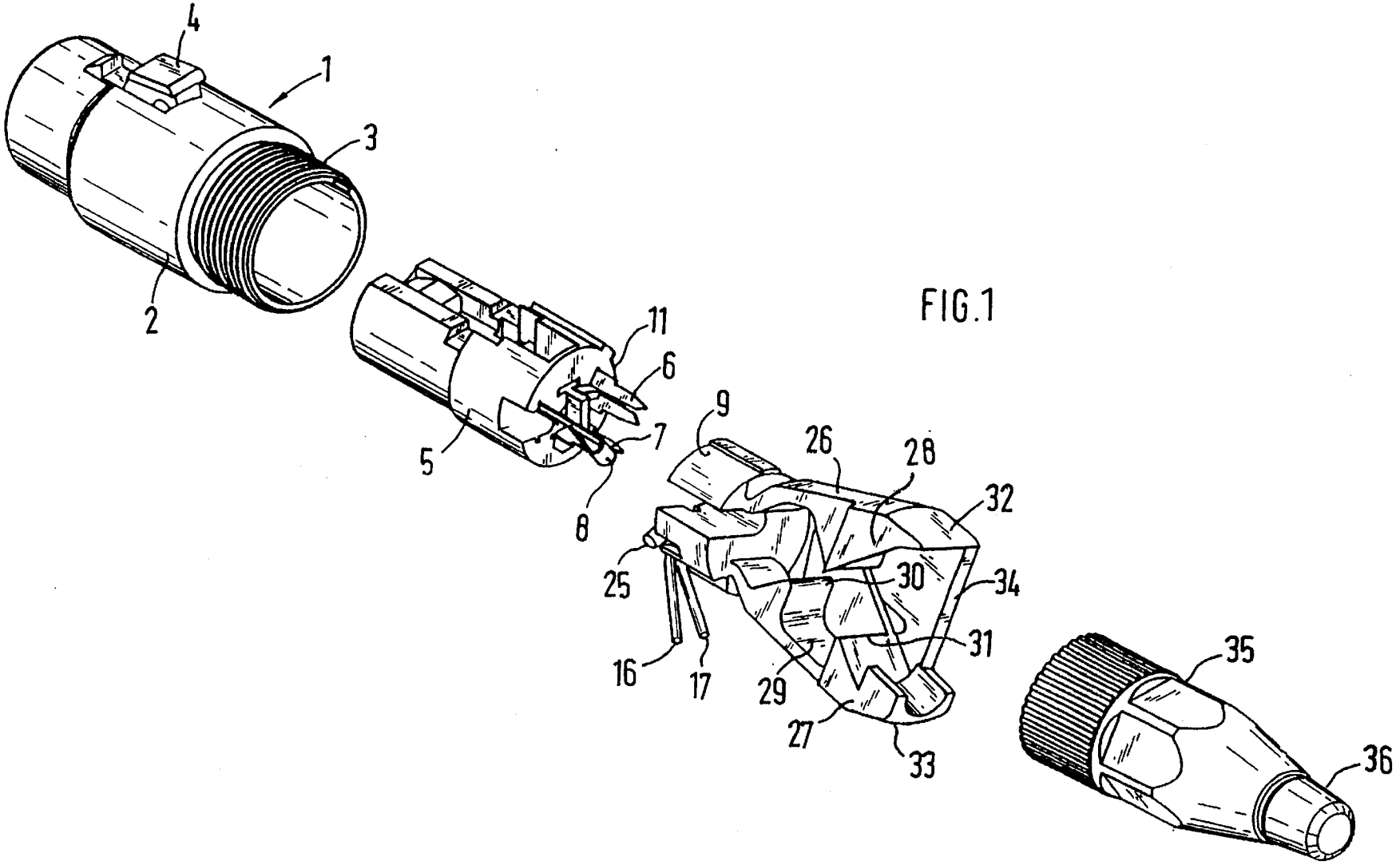
FIG. 1 shows a perspective of a coupling connection incorporating the invention.
Figure 2:
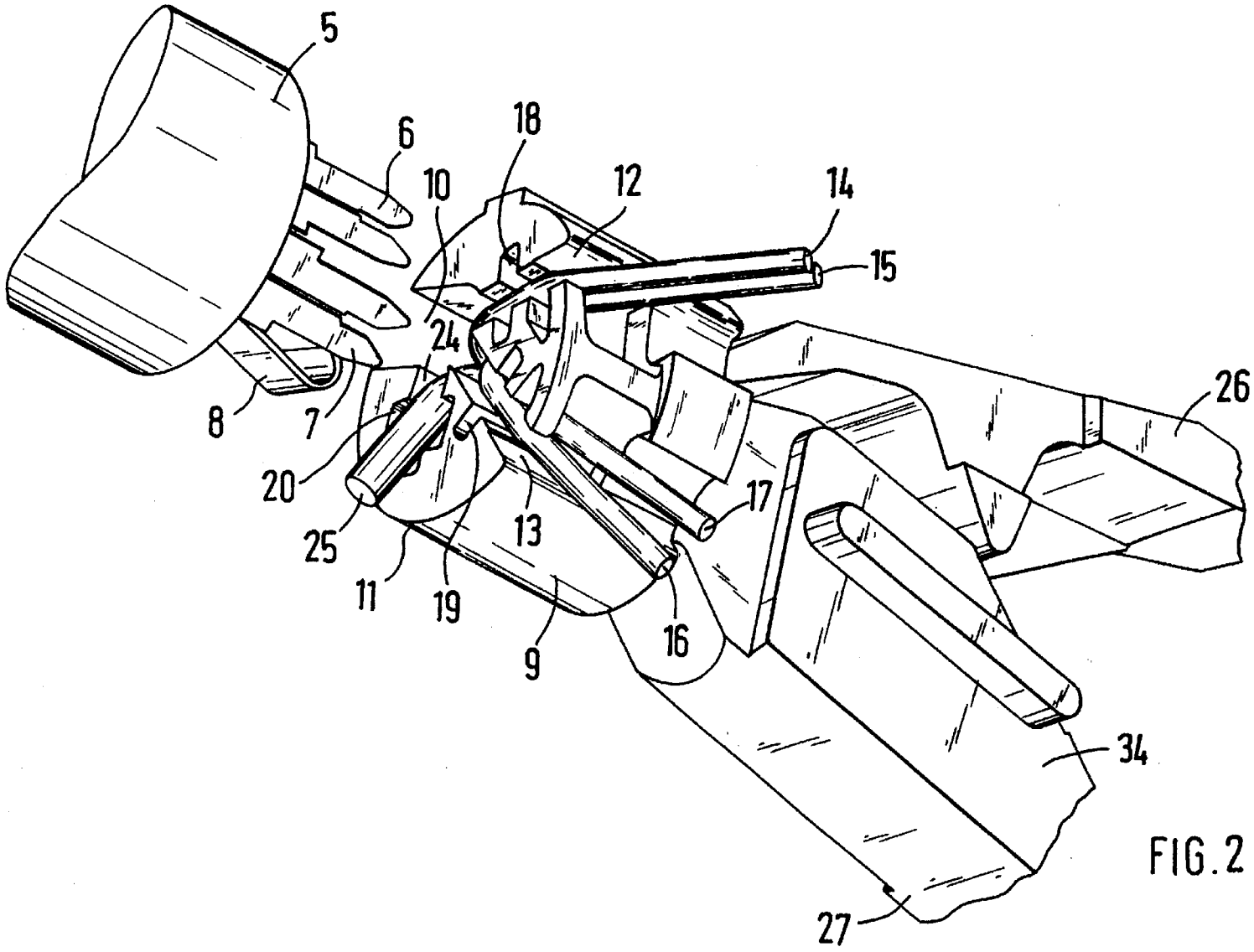
FIG. 2 shows an enlarged perspective of part of the coupling connector shown in FIG. 1.
Figure 3:
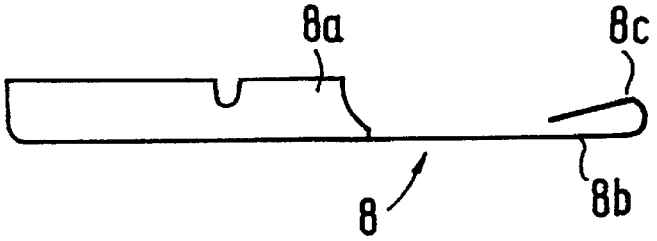
FIGS. 3 and 3*a* respectively show a side view and top view of the shield braid contact element incorporated in the coupling connector shown in FIGS. 1 and 2.
Figure 3A:
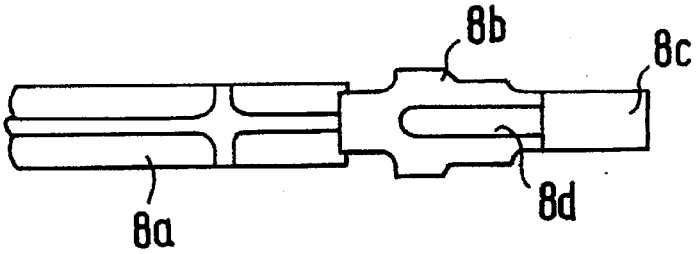

Referring to FIGS. 1 and 2, the connector element comprises a body of circular cross-section 1, including a shell portion 2 having a threaded free end 3 and a latch arrangement 4; an insert 5 constructed of a hard plastics material or a resilient material such as, for example, rubber. An array of three male or female contacts (not shown) extend outwardly from insert 5 parallel to the longitudinal axis of the insert. The rear portion of each contact element protrudes rearwardly through insert 5. Attached respectively to the rear portion of two of the contact elements are insulation displacement slotted plates 6 and 7, and to the remaining contact element is attached a shield braid contact spring 8 having a contact element part 8*a* for receipt of one of the contacts and a rear portion 8*b* in the form of a flat resilient metal spring which terminates in a loop 8*c*. Rear portion 8*b* is provided with a stiffening section 8*d*.

The connector element shown in FIGS. 1 and 2 further comprises a wire holding element 9 in the form of a cylindrical-shaped solid whose outer surface is provided with an axial channel 10 within the outer surface 11 of the wire holding element, and two radial channels 12 and 13 communicating with axial channel 10 for receiving insulated conductors 14, 15, 16 and 17. Transverse each channel is a scabbard 18 and 19 for receiving slotted plates 6 and 7 respectively. Wire holding element 9 further includes a rectangular receptacle 20 defined by four side walls and a bottom wall; two side walls 21 and 22 and bottom wall 23 being shown in FIGS. 5, 5*a* and 5*b*. Side walls 21 and 22 are slightly flared.

Receptacle 20 is provided with an entrance cut-out 24 to locate the shield braid pig-tail 25 at the entrance to the receptacle.

Wire holding element 9 further comprises a cord grip arrangement comprising two limbs 26 and 27 hingedly attached thereto and extending rearwardly. It will be understood that only one limb can be hinged. Limb 26 is provided with an inwardly extending transverse wedge 28 whose axis is substantially normal to the longitudinal axis of limb 26. Limb 27 is provided with a transverse channel section 29 opposite the thin edge of the wedge. The two sides of channel section 29 terminate in respective shoulders 30 and 31, shoulder 31 sloping rearward. Limbs 26 and 27 each terminate in a section 32 and 33 extending inwardly toward each other at an obtuse angle. A flat shroud 34 extends normal from one side of limb 27.

The connector element further comprises a cylindrical outer shell 35 having a rear section in the shape of a conical frustum through which a cable (not shown) to be connected enters. A resilient grommet 36 is fitted to the end of the rear section. The inner surface of the shell 35 is provided with a screw thread (not shown) for cooperation with screw thread 3 on the shell portion 3.

Figure 5:
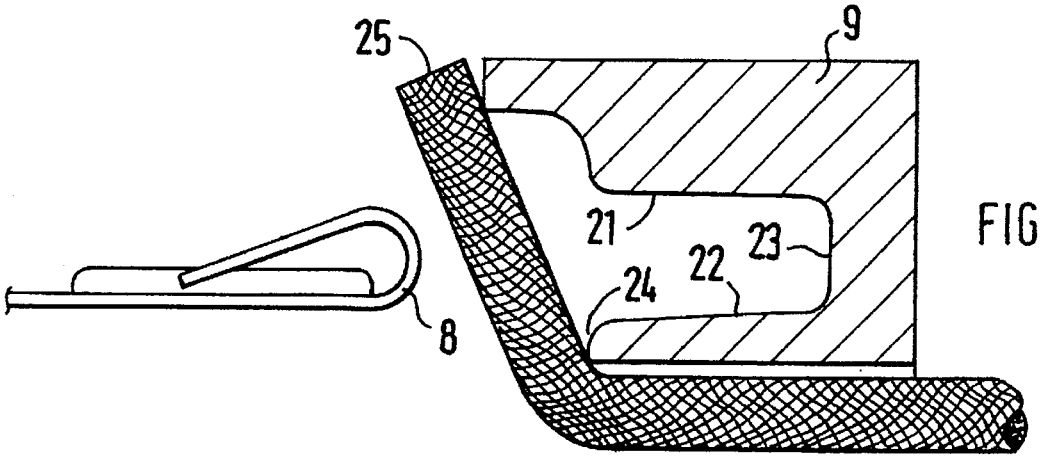
FIGS. 5, 5*a* and 5*b* illustrates the operation of shield braid contact element incorporated in the coupling connector shown in FIGS. 1 and 2.
Figure 5A:
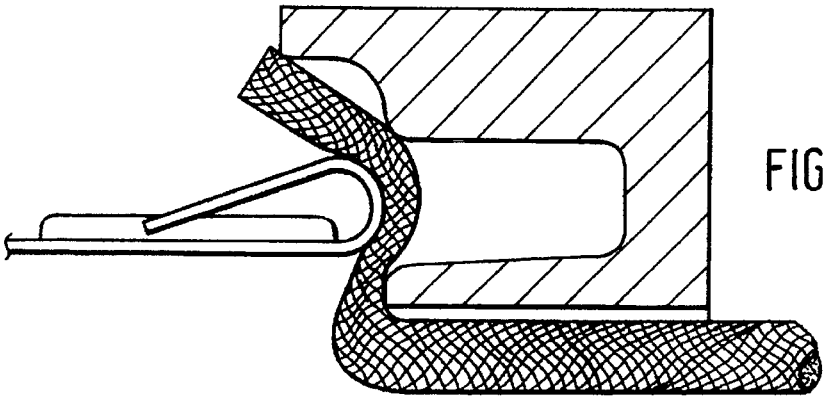
Figure 5B:
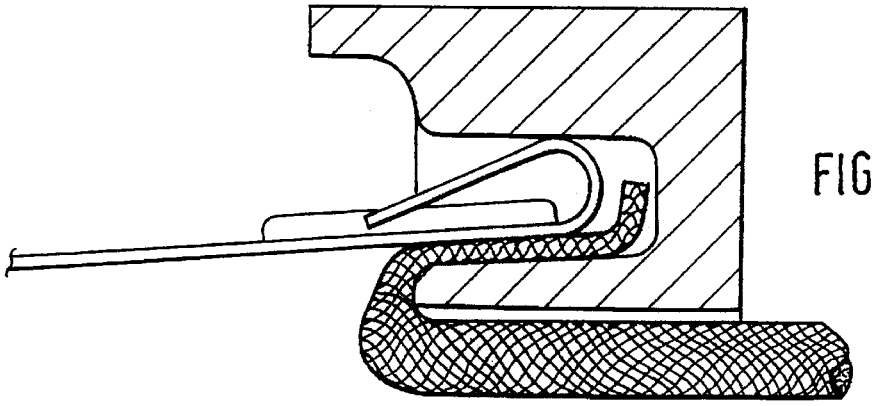

In operation, a cable (not shown) is fed through grommet 36 and a predetermined length of sheath is removed from the end of the cable to expose lengths of insulated conductors 14, 15, 16 and 17 and a length of shield braid. The shield braid is formed into a pig-tail 25 and located in the entrance cut-out 24 of receptacle 20. Insulated conductors 14 and 15 are laid in channel 12 and insulated conductors 16 and 17 are laid in channel 13 where they may be trimmed. The jaws are closed slightly and cylindrical outer shell 35 is pushed over the slightly closed jaws; wire holding element 9 axially enters shell portion 3 in which is located insert 5. The insulation displacement slotted plates 6 and 7 enter respective scabbards 18 and 19 and penetrate the insulation of insulated conductors 14, 15, 16 and 17 establishing electrical contact between the conductors and the contact elements. The free end of shield braid contact spring 8 enters rectangular receptacle 20 as illustrated in FIGS. 5, 5*a* and 5*b* crushing the shield braid and establishing electrical contact between the shield braid and a contact element.

Cylindrical outer shell 35 is screwed onto shell portion 3. The resulting axial movement of outer shell 35 causes the inner surface thereof to slidably abut sections 32 and 33 of the limbs thereby fixing the jaws closed and gripping the cord.

Figure 4A:
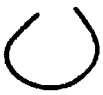
FIGS. 4 and 4*a* respectively show a top view and side view of an insulation displacement contact element incorporated in the coupling connector shown in FIGS. 1 and 2.
Figure 4:
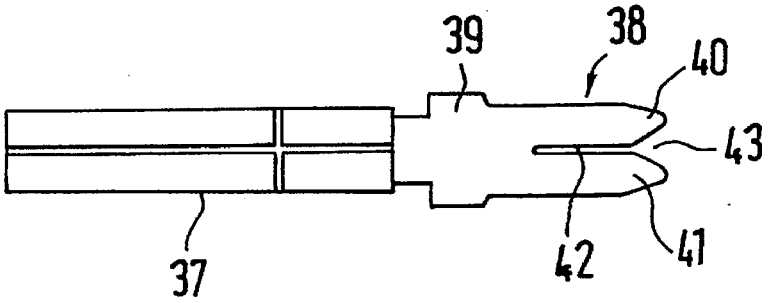

Referring to FIG. 4, the insulation displacement contact element comprises a forward section 37 and a rearward section 38. The forward section comprises an open-sided tube for axially receiving a male contact. The length of the forward section 37 is typically 15 mm. The rearward section 38 comprises a web section 39 from which extend two contact arms 40 and 41 each having a width of 2 mm and forming a slot 42. The free ends of each arm form a 60° flair 43 leading into slot 42. The length of the slot is approximately 5 mm and its width is 0.25 mm. The rearward section at least is constructed of phosphor bronze having a thickness of 0.25 min. The aforementioned dimensions are advantageously selected to provide a reliable contact between the conductors of two stacked insulated conductors and the contact element when the insulated conductors are inserted into the slot. The insulated conductors are typically 1.3 mm diameter each and contain a bundle of either 7 or 16 stranded conductors; the bundle having an approximate diameter of 0.5 mm and a predetermined packing factor. The selected thickness and width of each arm together with the selected width of the slot and the location of the stack of insulated conductors proximate the base of the slot provides a reliable contact between the conductors of both insulated conductors and the contact element.

It will be understood that a male forward section may be substituted for the open-sided tube described.

While the present invention has been described with regard to many particulars, it is understood that equivalents may be readily substituted without departing from the scope of the invention.

The claims defining the invention are as follows:

1. An electrical connector arrangement for making electrical connection between at least one contact element (8) and a corresponding conductor (25), the arrangement including a contact element carrying part (5) from which at least one contact element (8) protrudes having a resilient formed end (8*c*) at a rearward end and a contact element part (8*a*) at its other end dimensioned for receipt of a contact, and a conductor holding part (9) dimensioned for mateable engagement with the contact element carrying part (5), including at least one slot (20) to receive said at least formed end (8*c*) of the at least one contact element (8) and an end of said conductor (25), wherein said formed end (8*c*) is shaped to be a compression fit in said slot so that contact pressure is established between the contact element resilient formed end (8*c*) and the conductor (25) within said slot upon mating said contact element carrying part and said conductor holding part.

2. An arrangement as claimed in claim 1, wherein said conductor is a conductive shield element of a cable shielding at least one insulated wire of a cable.

3. An arrangement as claimed in claim 2, wherein said contact element carrying part axially supports within its boundary at least one further contact element having a rearwardly extending part which comprises an insulation penetrating member, and wherein said conductor holding part includes means for holding at least one insulated wire end of said cable transverse a further slot arranged to receive said insulation penetrating member upon mating said contact element carrying part and said conductor holding part.

4. An electrical connector arrangement for a sheathed cable containing at least one insulated conductor and a conductive shield element, said connector arrangement comprising:

an assembly of an outer shell member in which is fixedly located an insert member having fixedly supported within its boundary at least one first forwardly-extending contact element whose opposite end terminates in a rearwardly-extending insulation-penetrating member, and one second forwardly extending contact element whose opposite end terminates in a rearwardly-extending contact spring having a resilient formed end;

a mateable insulated-wire terminal including at least one first slot arranged to receive said insulation penetrating member, and a second slot arranged to receive said formed end of said rearwardly-extending contact spring and an end of said conductive shield element, when said contact element housing and said insulated wire terminal are axially mated, an insulated wire guide being arranged transverse said first slot, and said formed end being shaped to be a compression fit in said second slot;

a cup-shaped end member having a side wall joined by an end wall in which is provided a co-axial hole for receiving said sheathed cable therethrough and coupling means for releasably coupling said end member and said shell member;

said insulated wire terminal including a cable gripping means having two longitudinal limbs extending rearwardly from said insulated-wire terminal means to form a pair of jaws, at least one limb being hinged; and one of the two said limbs being provided intermediate its length with an inwardly extending protuberance opposite a space defined by two raised shoulders that extend inwardly from the other said limb, whereby when an end section of said cable is laid longitudinally between said limbs and a length of exposed at least one insulated conductor laid in said insulated wire guide, a part of said end section bridges said space such that upon closing said jaws, mating said contact element housing and said insulated-wire terminal, and coupling said end member and said shell member, said part of said end section of said cable is pinched and gripped between said shoulders and said protuberances, and said insulation-penetrating member cuts the insulation of said at least one insulated wire in said insulated wire guide to provide electrical connection between said insulated wire and said first forwardly extending contact element, and contact pressure is established between said formed end of said contact spring and said end of said conductive shield element to provide electrical connection between said conductive shield element and said second forwardly-extending contact element.

5. An electrical connector arrangement as claimed in claim 4, wherein a plurality of first forwardly-extending contact elements are fixedly supported in an array within the boundary of said insert member for reception in an array of first slots in said insulated-wire terminal for electrically connecting said first forwardly-extending contact elements to respective insulated conductors.

6. An electrical connector arrangement as claimed in claim 5, wherein said insulation-penetrating member comprises a slotted plate having two oppositely-spaced knife edges.

7. An electrical connector arrangement as claimed in claim 6, wherein said insulation penetrating member comprises a slot formed between a pair of contact arms with width W adapted to receive wires with an insulation diameter DO and a wire diameter D1, wherein D1 is greater than W, and wherein the deformation characteristics of the wires when inserted into the slot and the resilience of the contact arms are such that the edges of the contact arms forming the slot make electric contact with each of a pair of wires inserted into the slot.

8. An electrical connector arrangement as claimed in claim 3, wherein said insulation-penetrating member comprises a slotted plate having two oppositely-spaced knife edges.

* * * * *